US005215195A

United States Patent [19]

Williams

[11] Patent Number: 5,215,195

[45] Date of Patent: Jun. 1, 1993

[54] PROTECTORS

[75] Inventor: Ernest D. Williams, Merseyside, United Kingdom

[73] Assignee: Willdaw Foam & Packaging Limited, England

[21] Appl. No.: 760,594

[22] Filed: Sep. 16, 1991

[30] Foreign Application Priority Data

Sep. 15, 1990 [GB] United Kingdom ..... 9020208
Jun. 20, 1991 [GB] United Kingdom ..... 9113305

[51] Int. Cl.[5] ..... B65D 81/16

[52] U.S. Cl. ..... 206/446; 206/203; 206/523; 220/509; 220/528

[58] Field of Search ..... 206/201, 203, 427, 433, 206/523, 587, 592, 446; 220/4.01, 9.1, 509, 512, 513, 528

[56] References Cited

U.S. PATENT DOCUMENTS

| | | | |
|---|---|---|---|
| 2,903,150 | 9/1959 | Rehrig | 220/509 |
| 3,029,970 | 4/1962 | Brandon | 220/509 |
| 3,421,679 | 1/1969 | Goldman | 206/523 |
| 3,837,560 | 9/1974 | Kuchuris . | |
| 4,122,946 | 10/1978 | Holley | 206/523 |
| 4,306,675 | 12/1981 | Swanson . | |
| 4,703,855 | 11/1987 | Moe et al. | 206/427 |
| 4,754,880 | 7/1988 | Tehrani . | |
| 4,887,716 | 12/1989 | Abraham | 206/427 |

FOREIGN PATENT DOCUMENTS

| | | | |
|---|---|---|---|
| 2319260 | 11/1973 | Fed. Rep. of Germany . | |
| 2700107 | 7/1978 | Fed. Rep. of Germany | 206/203 |
| 1066615 | 4/1967 | United Kingdom . | |
| 1247002 | 9/1971 | United Kingdom . | |
| 1397333 | 6/1975 | United Kingdom . | |
| 1419168 | 12/1975 | United Kingdom . | |
| 2081678 | 2/1982 | United Kingdom . | |
| 2199564 | 7/1988 | United Kingdom . | |
| 2218406 | 11/1989 | United Kingdom | 206/523 |

*Primary Examiner*—Jimmy G. Foster
*Attorney, Agent, or Firm*—Kirschstein, Ottinger, Israel & Schiffmiller

[57] ABSTRACT

An article protector, such as may be used to protect bottles during transportation, is assembled from a plurality of interfitting parts which may be interfitted to provide an open framework within which a bottle may be supported and securely held for protection, the members are produced by being stamped from cellular plastics material providing in sheet or slab form. The interfitting members may be permanently secured together to provide to superstructures which may be located together around the articles to be protected, being secured together by releasable securing means or may be provided y members which are retained in an enclosing condition by virtue of being located within a carton.

12 Claims, 8 Drawing Sheets

FIG 6
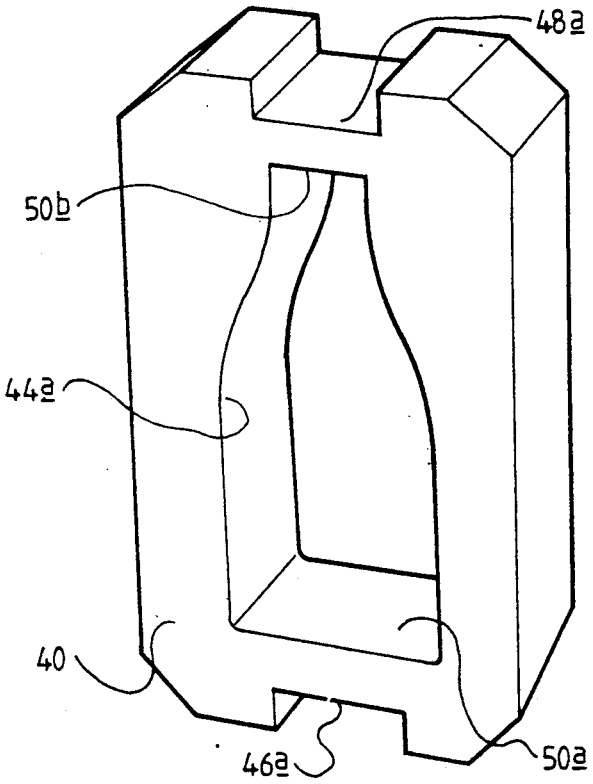
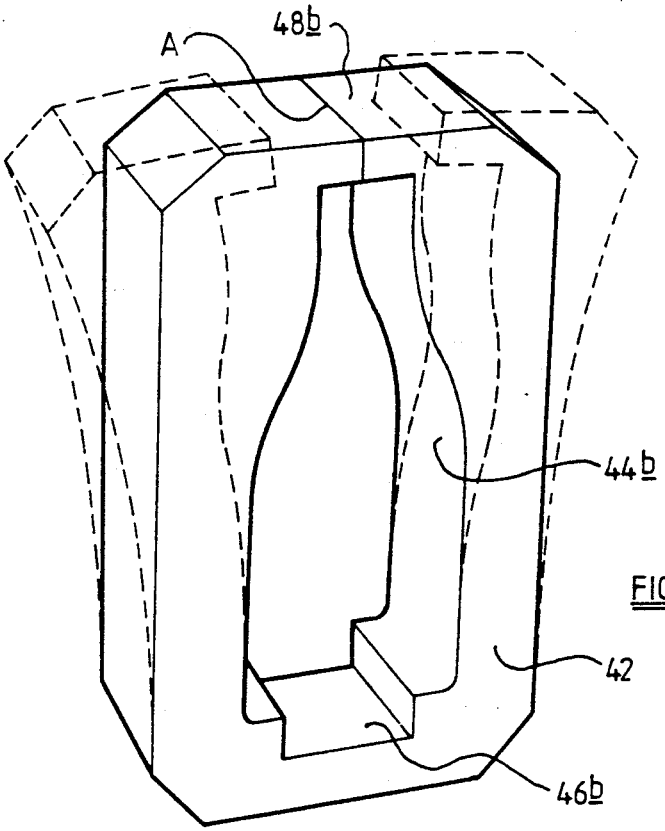
FIG 7

PROTECTORS

FIELD OF THE INVENTION

This invention is concerned with improvements relating to protectors, particularly of the kind (hereinafter referred to as being of the kind specified) as are used to support and protect fragile articles [such as bottles or electronic components] during transport.

BACKGROUND OF THE INVENTION

Conventionally protectors of the kind specified are provided by an injection moulding operation, being moulded for example of polyurethane foam. Such protectors are in consequence expensive to produce, and are only viable if a large number of protectors are to be manufactured.

SUMMARY OF THE INVENTION

According to this invention there is provided a protector of the kind specified, comprising a plurality of members produced by cutting from resilient material in slab or sheet form, the members being interfitted so as to extend around the article or articles.

Preferably the members interfit, for example by being provided with interfitting slot formations, to provide a framework of open construction, within which the article or articles is or are located. Thus preferably the members provide one or more surfaces which define interior cavities which are preferably of open construction, within each of which an article to be protected is or may be nested.

Some at least of the members may be permanently secured together, for example by adhesive, or welding, such as heat welding, and/or some at least of the members may be releasably secured together, e.g. by an elastic band or string.

Preferably the members when assembled together conform in part at least to the surface profile of the article or articles to be protected, and preferably engage or are adapted to be engaged by the article or articles to be protected in a plurality of mutually transverse planes.

Thus, where the article to be protected is circular in cross-section, the members are interfitted so as to engage or adapted to be engaged by the article in a plurality, preferably four, tangential planes.

Additionally, the members when interfitted may also engage or adapted to be engaged by the article at end regions thereof at planes transverse to said tangential planes.

According to this invention there is provided a protector of the kind specified comprising a plurality of members of resilient material adapted to be secured together to define one or more interior cavities in which or in each of which one or more articles to be protected may be nested.

According to this invention there is also provided a method of providing a protector of the kind specified, involving stamping a plurality of members from resilient material, and securing the members together to provide a protector having one or more interior cavities in which or in each of which one or more articles to be protected may be nested.

According to this invention there is also provided a kit-of-parts for use in the assembly of a protector of the kind specified, said kit-of-parts comprising a plurality of members cut or stamped from resilient material, the members being so constructed as to enable them to be interfitted to provide a framework of open construction to extend around and support and protect the article or articles.

According to this invention there is also provided an assembly comprising a carton, and located within the carton a protector according to any one of the preceding claims, one or more articles to be protected being located within the protector and the protector being retained, firmly to engage the article or articles, by virtue of the location of the protector in the carton.

In this manner the members may readily be flexed around the article or articles into interfitting relationship, securely to protect the article or articles by virture of the location of the protector within the carton. On removal from the carton the members may be flexed to open the protector to enable the article or articles to be removed therefrom.

The members may be of polypropylene, polyurethane, polyethylene or any similar convenient plastics material, preferably being of cellular (foam) construction.

DESCRIPTION OF THE DRAWINGS

FIGS. 6 and 7 are perspective views showing the two members of the second embodiment;

DETAILED DESCRIPTION OF PREFERRED EMBODIMENTS

Figure 1:
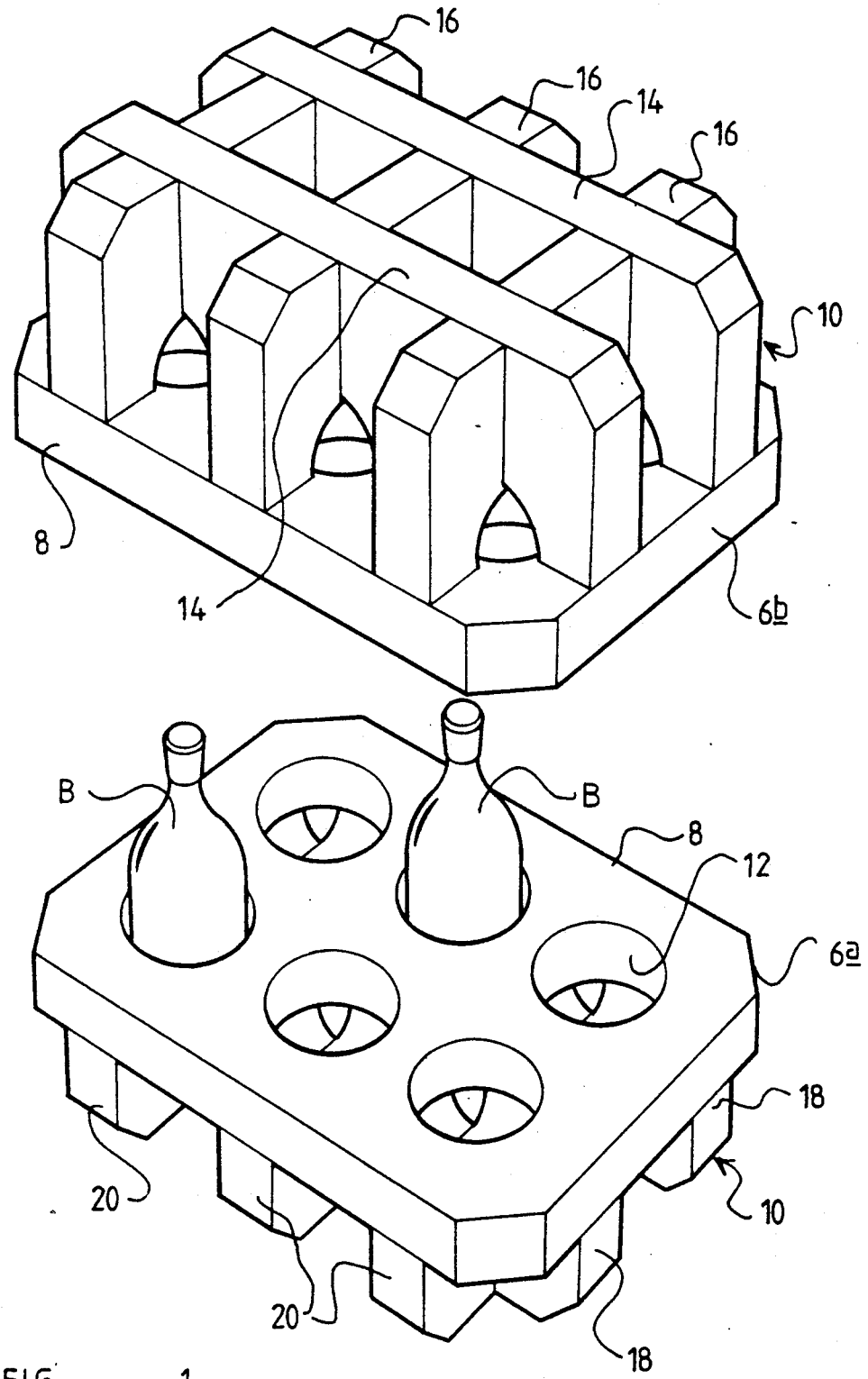
FIG. 1 is a perspective view showing a first embodiment of the invention.
Figure 2:
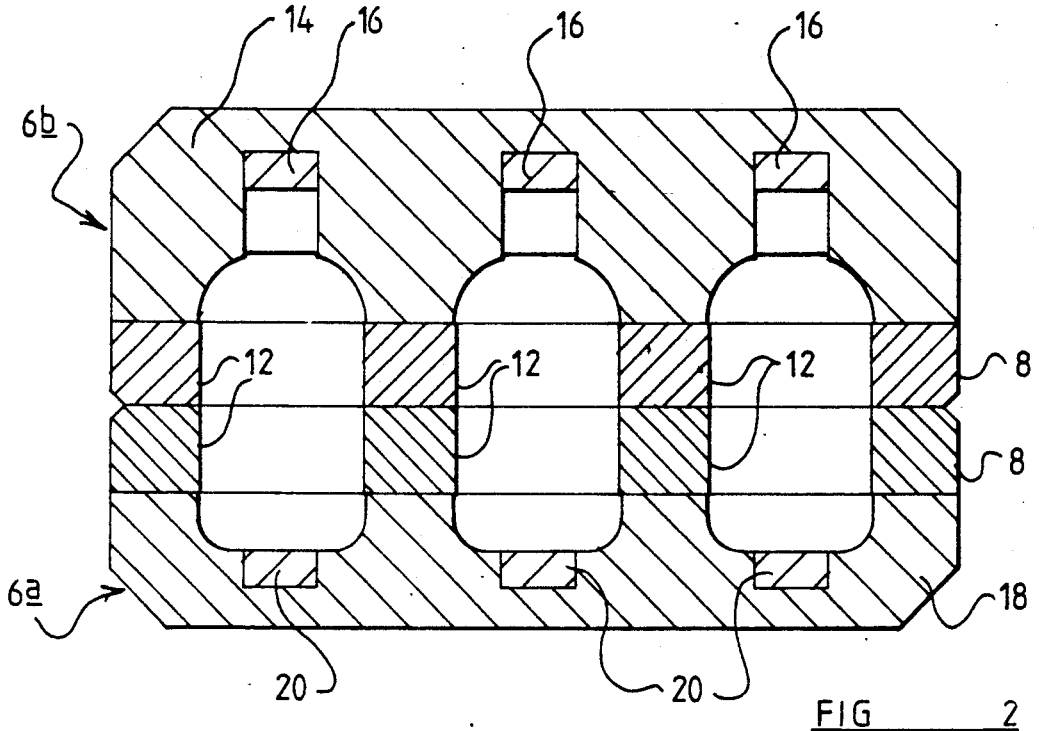
FIGS. 2 and 3 are sectional views of the protector shown in FIG. 1, taken along mutually perpendicular planes.
Figure 3:
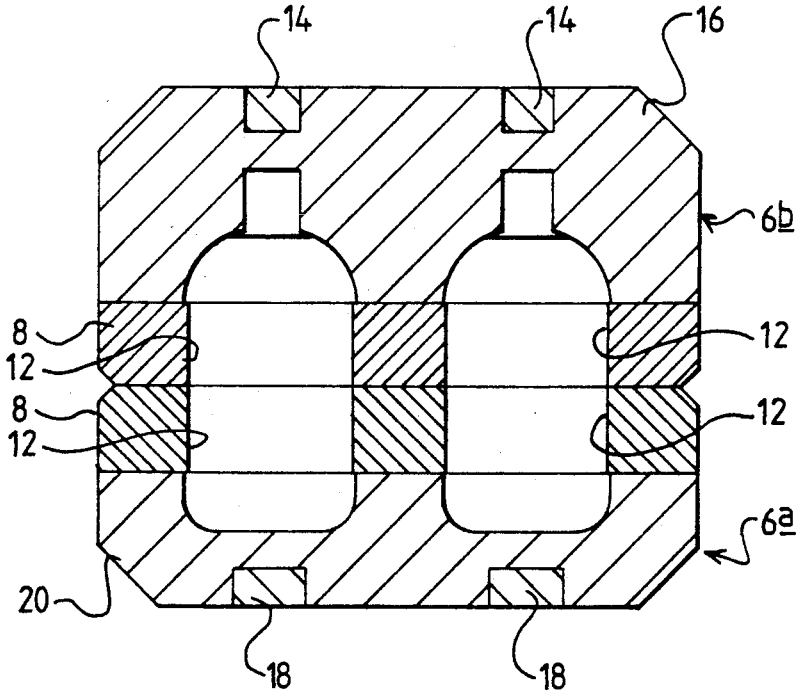

The protector which is the first embodiment of the invention comprises two parts 6*a*, and 6*b*, conveniently referred to as the lower part and the upper part respectively. Each part comprises a generally flat base 8 and a superstructure 10, the flat base being of generally rectangular form and being provided with a plurality, specifically six cylindrical apertures 12. The superstructure 10 of the upper part comprises two longitudinal members 14 and three transverse members 16, each being provided with channels (FIG. 4) to enable them to be interfitted to provide the superstructure, and the superstructure of the lower part comprises two longitudinal members 18 and three transverse members 20, each similarly being provided with channels to enable them to be interfitted.

In the first embodiment the longitudinal members 14 and 18 are provided with channels 21*a* and 22*a* respectively, whilst the transverse members 16 and 20 are provided with interfitting channels 21*b* and 22*b* respectively.

When the individual members have been interfitted to provide the superstructure, they may be secured together by the application of heat along adjacent edges to effect heat welding. Alternatively other forms of securing may be used, such as adhesive. The superstructure may then be secured to the base 8, again conveniently by heat welding.

Each of the protector parts 6*a* and 6*b* provides, an open-structured cavity part which, when the two protector parts are brought together, define a cavity in which the article to be protected may be nested.

Thus in the first embodiment bottle B may be placed into the cavity part of the base part of the protector, and the upper part positioned over the bottles and secured to the base part, if desired by the heat welding or adhesive, but conveniently by the use of removable securing means such as tape, or elastic bands.

Figure 4:
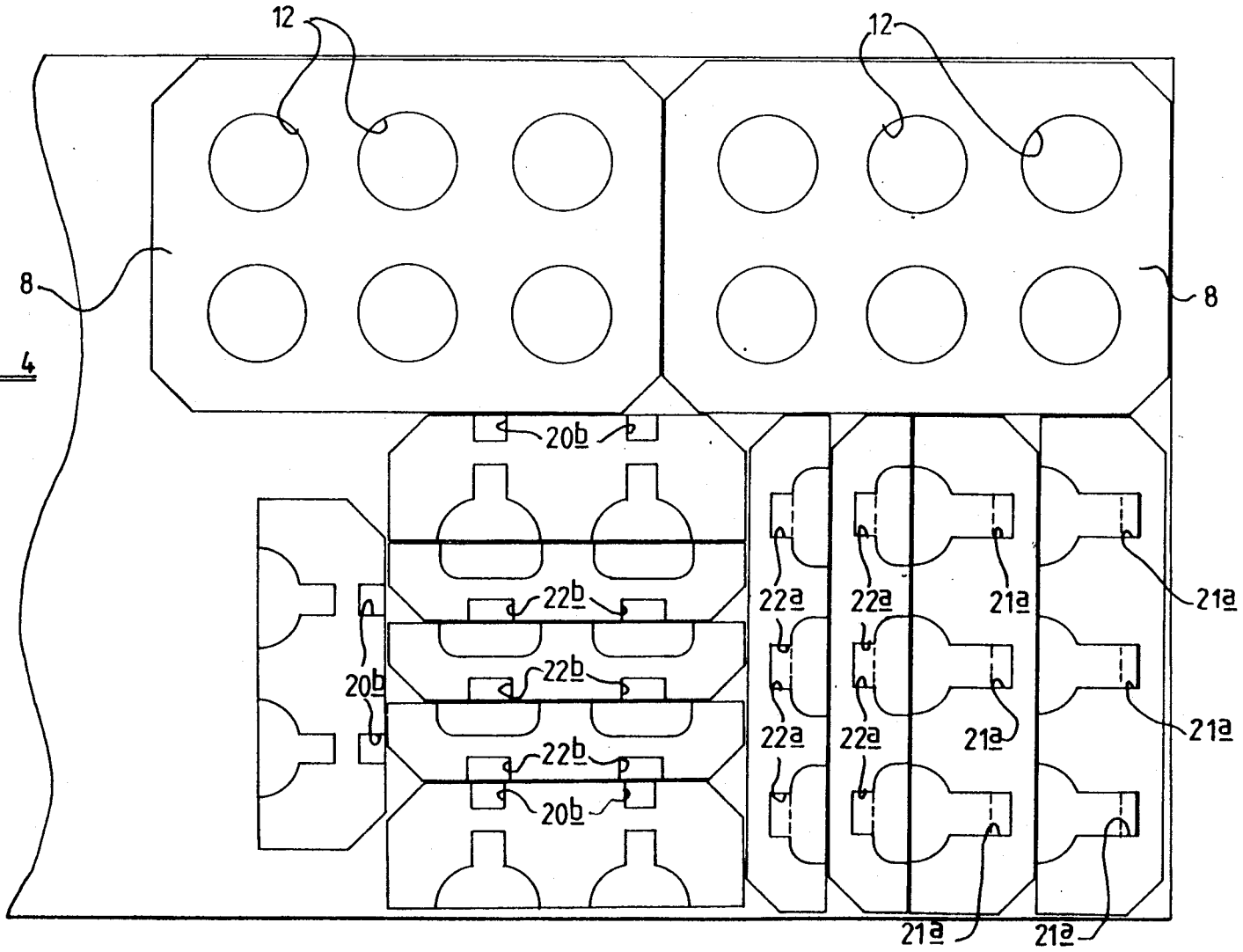
FIG. 4 is a view illustrating the manufacture of the protectors.

The protector which is the first embodiment of this invention is produced from foam polypropylene in slab or sheet form, the thickness of the sheet corresponding to the thickness of the members 8, 10, 14, 16, 18 and 20, from which sheet said members are produced by a stamping operation, as shown in FIG. 4. In this manner the various parts of the protector may be produced economically, and the protector assembled for use conveniently and relatively inexpensively.

It is however to be appreciated that the particular construction of interfitting slots to secure the various elements together may be other than as illustrated in the preferred embodiment, and specifically if desired, a construction may be utilised in which the longitudinal and/or transverse members are also interfitted with the base members 8, around the periphery thereof.

Figure 5:
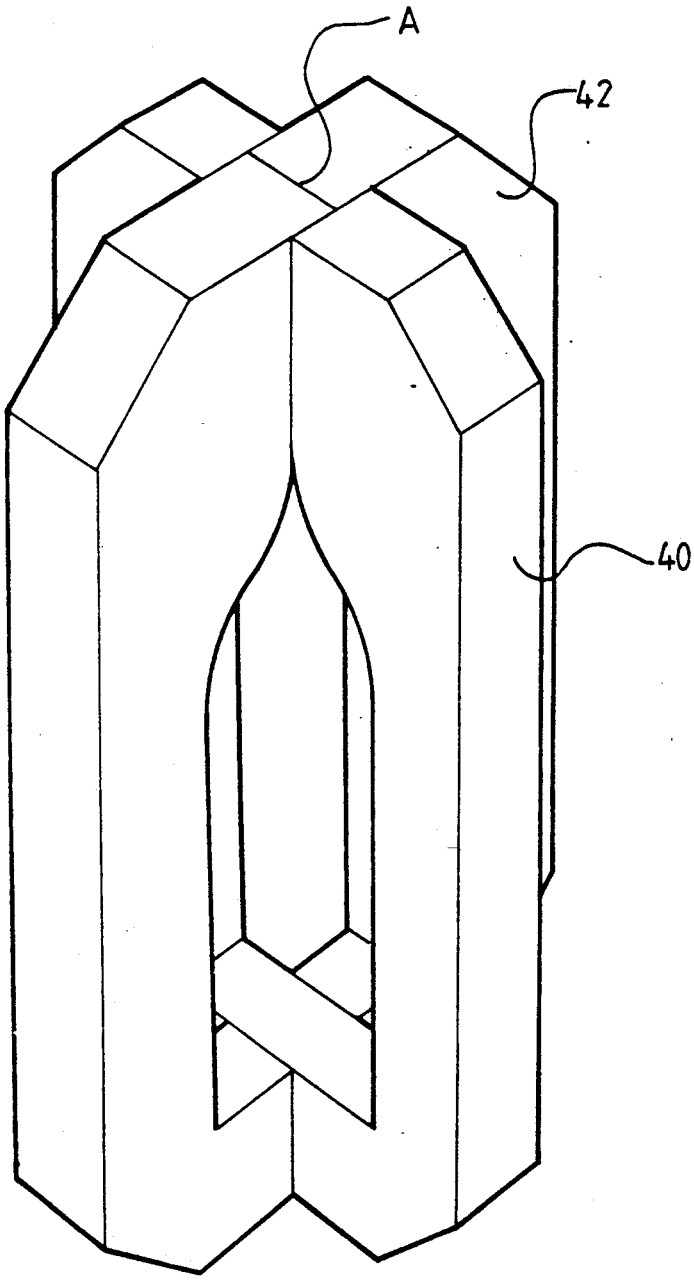
FIG. 5 is a perspective view showing the protector which is a second embodiment of the invention.

The protector which is the second embodiment of the invention, shown in FIG. 5, involves the use of two support members 40, 42 shown in FIGS. 6 and 7 respectively. Each of these members 40 and 42 is provided with an interior cavity 44*a* and 44*b* respectively, conforming generally in the cross-section of the article to be supported, and comprises interfitting formations, 46*a*, 48*a*, 46*b* and 48*b*. Whilst the member 40 is of solid form, the member 42 is split along the line A shown in FIG. 7, enabling the member 42 to be flexed outwardly, into the configuration shown in dotted lines in FIG. 7, in which it can be fitted around the member 40, with the formation 46*a*, and 46*b* slotting into one another, and the formations 48*b* entering into the slot 48*a*. Thus, by positioning a bottle within the cavity part 44*a*, and then springing the member 42 around the member 40 and bottle, the bottle is engaged around the sides on four, mutually perpendicular tangential planes, and, at the bottom and top, by two transverse planes 50*a* and 50*b* engaging respectively the bottom and the top of the bottle.

The protector as shown in FIG. 5 may be then located in a rectangular carton, engagement with the side walls of which prevent open flexing of the member 42, ensuring that the protector is maintained in firm engagement with the bottle, to protect it during transit.

As with the first embodiment the members 40 and 42 are produced by being stamped from sheet or slab cellular polyethylene, although other materials may be used as desired.

Alternatively or in addition, the members 40 and 42 may be retained together by the use of tape, string or an elastic band.

Figure 8:
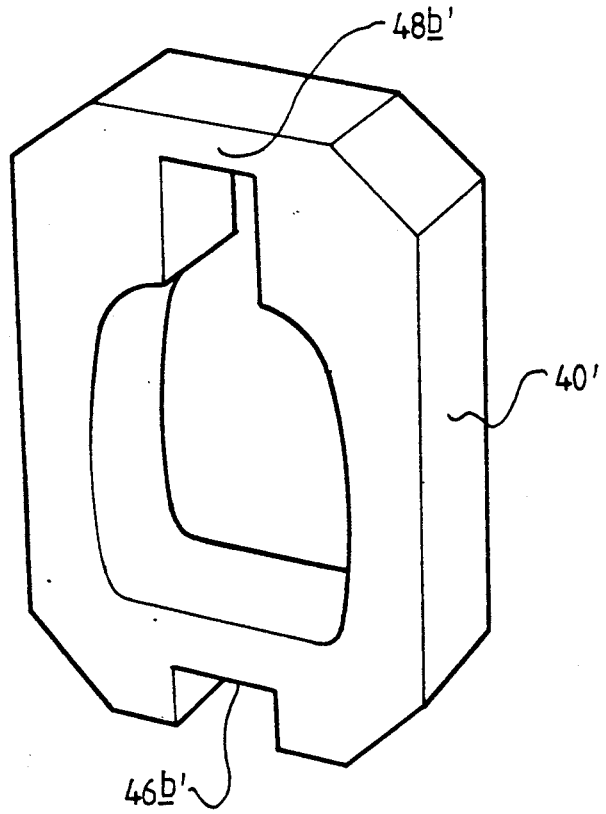
FIGS. 8 and 9 show alternative constructions of the members shown in FIGS. 6 and 7, respectively.
Figure 9:
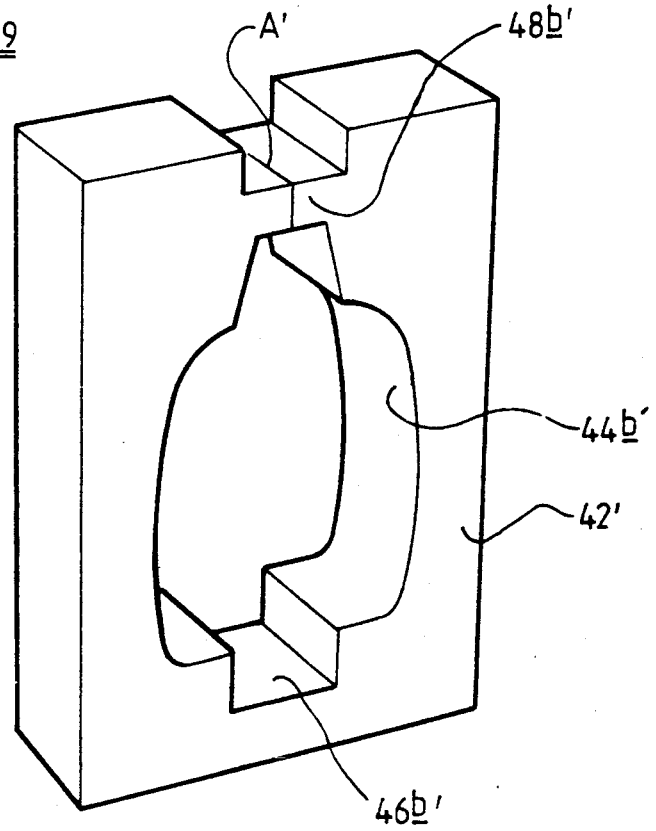

Shown in FIGS. 8 and 9, in which similar numerals with an apostrophe (') are used to denote like parts, modified shapes of the members 40' and 42' are shown. In this modified construction, the formations 48*b'* of the member 42' engage beneath the formation 48' of the member 40', allowing the upper parts of the cavity 44*b'* more easily to be shaped into the configuration of the article to be protected, to enable a firm gripping (e.g.) of the neck of a bottle to be obtained, when the member 42' is closed around the article to be protected.

Figure 10:
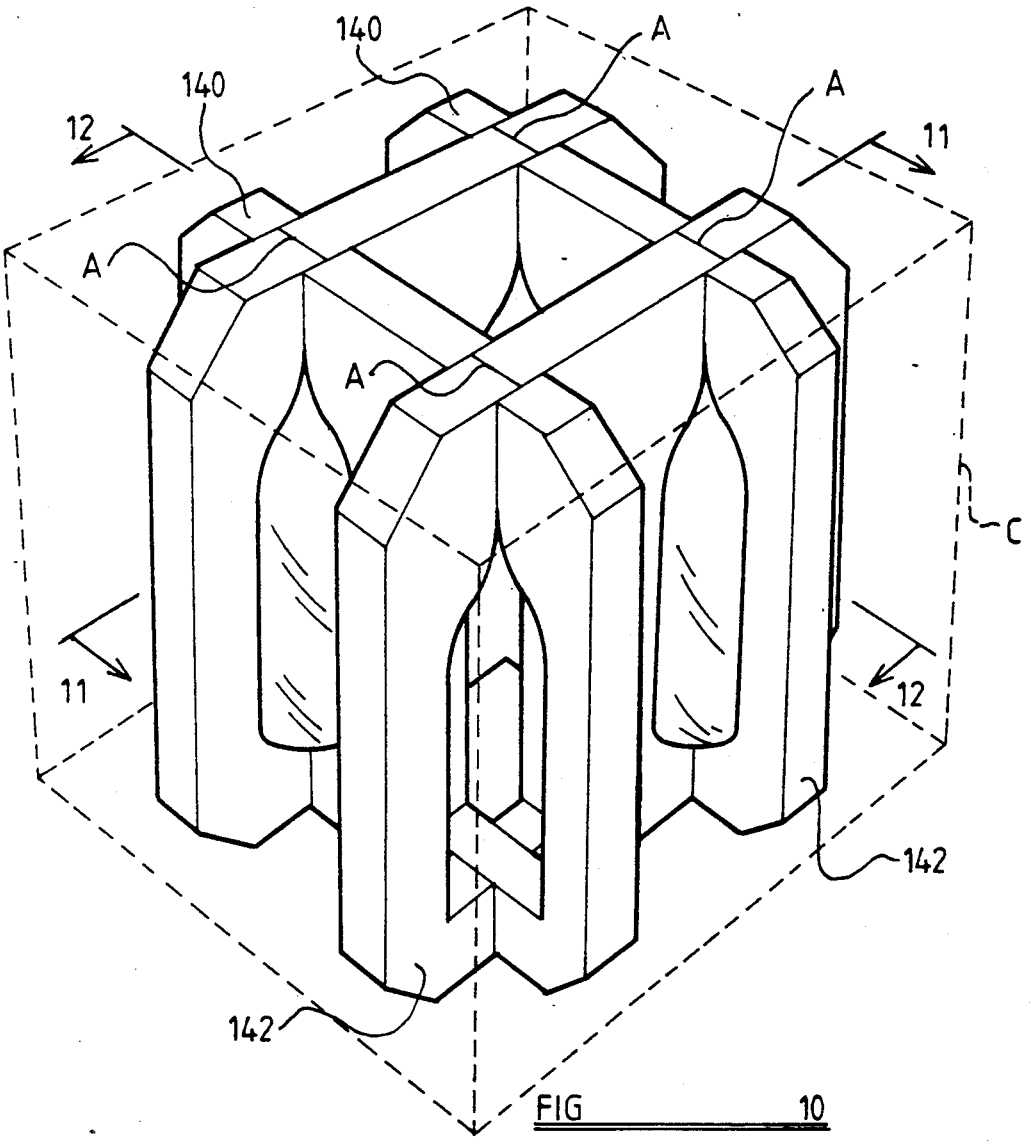
FIG. 10 is a view showing the application of the second embodiment in a protector for protecting a plurality, specifically four, articles to be protected.
Figure 11:
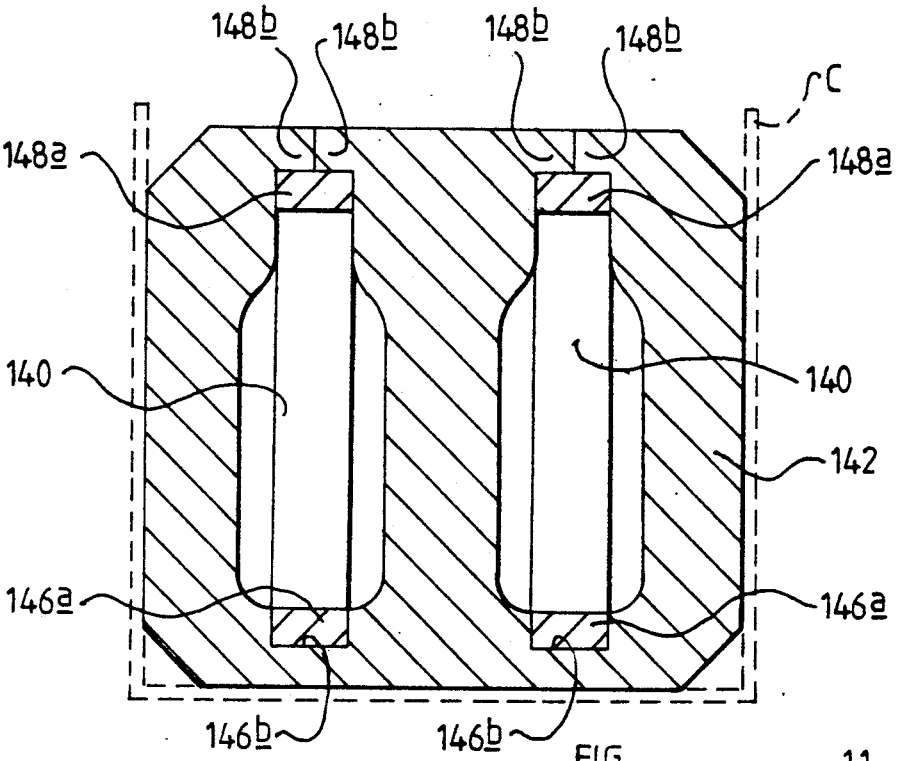
FIG. 11 is a sectional view of the protector shown in FIG. 10, taken on the line 11—11 of FIG. 10.
Figure 12:
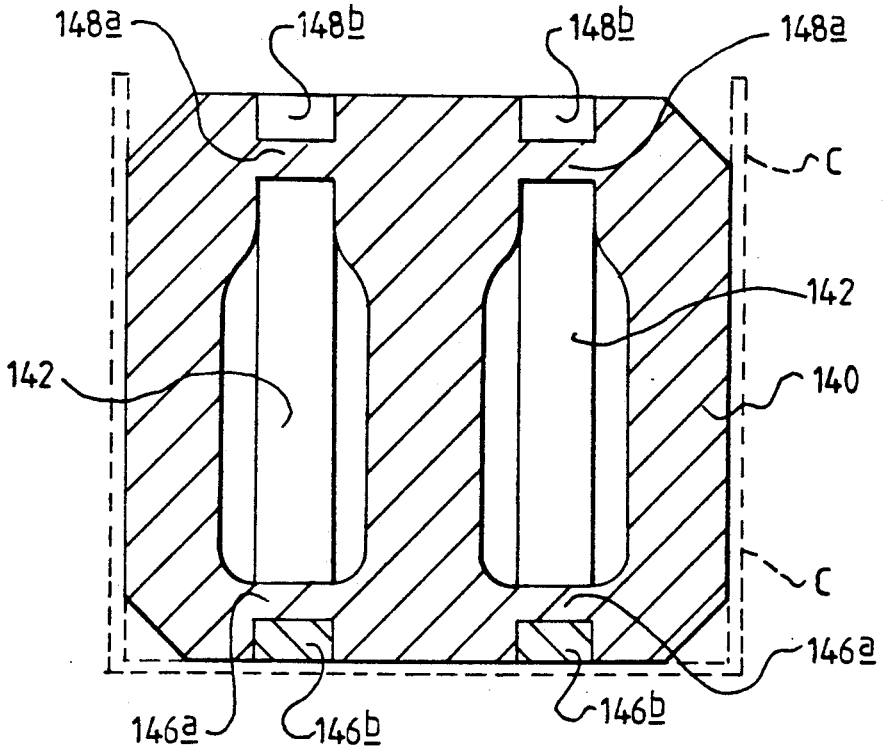
FIG. 12 is a sectional view taken on the line 12—12 of FIG. 10.

The application of the technique of the second embodiment to a multi-article protector is shown in FIG. 10, in which similar numerals, increased by 100, have been utilised to indicate those parts shown in FIGS. 6 and 7. The same principle of assembly is however utilised, the bottles being placed within the lower cavities 144*a* of the solid part 140 prior to enclosure therearound of the openable members 142, to provide the framework of open-work construction embracing the bottles and holding them in position during transportation. As previously, location of the protector illustrated in FIG. 10 in a carton of appropriate size (shown in dotted lines in FIGS. 10, 11 and 12 and indicated C) will prevent open wood flexing movement of the parts 142, ensuring that the bottles are retained with a firm grip within the protector.

I claim:

1. A bottle protector and a bottle, comprising, in combination: a plurality of members produced by cutting from resilient material in a sheet form, the members being interfitted so as to provide a framework defining at least one interior cavity of open construction within which the bottle to be protected is nested, at least one of the members being inclined so as to engage a shoulder of the bottle tangentially.

2. The combination according to claim 1, wherein inclined surfaces are provided to engage the shoulder of the bottle tangentially on opposite sides.

3. The combination according to claim 2, wherein the members provide four sloping surfaces to engage the shoulder of the bottle at four locations around the periphery thereof.

4. The combination according to claim 1, wherein at least a plurality of the members are permanently secured together.

5. The combination according to claim 1, wherein at least a plurality of the members are releasably secured together.

6. The combination according to claim 1, wherein the members when interfitted conform interiorly in part at least to a surface profile of the bottle to be protected.

7. The combination according to claim 1, wherein the members engage the bottle to be protected in a plurality of mutually transverse planes.

8. The combination according to claim 7, wherein the members when interfitted engage the bottle at end regions thereof in planes transverse to said tangential planes.

9. The combination according to claim 1, wherein the members are selected from the group consisting of polypropylene, polyurethane and polyethylene of cellular construction.

10. The combination according to claim 1, wherein the members are rectangular in cross-section.

11. A kit of parts for use in the assembly of a bottle and a bottle protector, said kit of parts comprising: a plurality of members produced by cutting from resilient material in slab form, the members being interfitted so as to provide a framework defining at least one interior cavity of open construction within which the bottle to be protected is nested, at least one of the members being curved to engage a shoulder of the bottle tangentially.

12. An assembly comprising: a carton, a protector located within the carton, and a bottle, the protector comprising a plurality of members produced by cutting from resilient material in slab form, the members being interfitted so as to provide a framework defining at least one interior cavity of open construction within which the bottle to be protected is nested, at least one of the members being curved to engage a shoulder of the bottle tangentially, the protector being retained around, firmly to grip the bottle, by virtue of its location within the carton.

* * * * *